US009907368B2

(12) United States Patent
Paik et al.

(10) Patent No.: US 9,907,368 B2
(45) Date of Patent: Mar. 6, 2018

(54) BUCKLE

(71) Applicant: WOOJIN PLASTIC CO., LTD., Guri-si, Gyeonggi-do (KR)

(72) Inventors: Jisook Paik, Seoul (KR); Nan Hee Paik, Seoul (KR); Ji Hye Paik, Seoul (KR); Ji Won Son, Seoul (KR)

(73) Assignee: WOOJIN PLASTIC CO., LTD., Guri-si (KR)

( * ) Notice: Subject to any disclaimer, the term of this patent is extended or adjusted under 35 U.S.C. 154(b) by 0 days.

(21) Appl. No.: 15/297,499

(22) Filed: Oct. 19, 2016

(65) Prior Publication Data

US 2017/0127768 A1 May 11, 2017

(30) Foreign Application Priority Data

Nov. 5, 2015 (KR) ..... 10-2015-0154883

(51) Int. Cl.

| | |
|---|---|
| ***A44B 11/26*** | (2006.01) |
| ***A44B 11/25*** | (2006.01) |
| ***A41F 1/00*** | (2006.01) |
| ***A44B 11/00*** | (2006.01) |

(52) U.S. Cl.

CPC ..... *A44B 11/266* (2013.01); *A41F 1/002* (2013.01); *A44B 11/005* (2013.01); *A44B 11/006* (2013.01); *A44B 11/2584* (2013.01); *A44D 2201/00* (2013.01); *A44D 2201/30* (2013.01)

(58) Field of Classification Search

CPC ..... Y10T 24/45529; Y10T 24/45534; A44B 11/005; A44B 11/006; A44B 11/2584; A41F 1/002

See application file for complete search history.

(56) References Cited

U.S. PATENT DOCUMENTS

| | | | | |
|---|---|---|---|---|
| 5,465,472 | A * | 11/1995 | Matoba | A44B 11/266 24/616 |
| 7,320,160 | B2 * | 1/2008 | Uehara | A44B 11/266 24/614 |
| 2002/0040514 | A1 * | 4/2002 | Uehara | A44B 11/266 24/614 |
| 2005/0235470 | A1 * | 10/2005 | Uehara | A44B 11/266 24/615 |
| 2013/0232743 | A1 * | 9/2013 | Takazakura | A44B 11/266 24/625 |
| 2017/0172262 | A1 * | 6/2017 | Paik | A44B 11/2592 |

* cited by examiner

*Primary Examiner* — Robert J Sandy

(74) *Attorney, Agent, or Firm* — Novick, Kim & Lee, PLLC; Jae Youn Kim

(57) ABSTRACT

Provided is a buckle including a plug member and a socket member, wherein the plug member includes lock arms and a guide rod located at a middle position between the lock arms, and the socket member includes a holder formed in a chamber so as to catch the lock arm. The guide rod is provided on the front end thereof with a holding member, and the socket member is centrally provided with a guide groove for the coupling of the guide rod and is also provided with a holding protrusion for the coupling of the holding member. As such, in addition to the coupling between the lock arm and the holder, another coupling structure is provided so as to prevent the buckle from being easily unfastened by unintentional external contact or pressure while ensuring convenient separation of the buckle with one hand as needed.

19 Claims, 11 Drawing Sheets

BUCKLE

CROSS-REFERENCE TO RELATED APPLICATION

This application claims the priority to Korean patent application No. 10-2015-0154883 filed on Nov. 5, 2015, the disclosure of which is incorporated by reference in its entirety.

BACKGROUND OF THE INVENTION

Field of the Invention

The present invention relates to a buckle, and more particularly, to a buckle, which includes a socket member and a plug member separably coupled to each other, each of the socket member and the plug member being mounted on an end of a belt or strap attached to any of various articles, such as, for example, an article of clothing, a bag, a knapsack, or a helmet.

Description of the Related Art

Generally, a buckle is a fastening device in which a plug member and a socket member are coupled and fixed to each other as described above. These constituent members of the buckle are integrally molded from a plastic material so as to implement elastic coupling therebetween.

FIG. 1 is a schematic perspective view illustrating an example of a conventional buckle. The conventional buckle includes a plug member 10 and a socket member 20.

As illustrated in FIG. 1, the plug member 10 includes a pair of lock arms 12, which protrude in a straight line from a base 11 of a body and have elasticity. A fastening portion protrudes outward from the front end of each lock arm 12. The plug member 10 further includes a guide rod 13, which is located between the lock arms 12 and extends a long length in a straight line from the base 11. The socket member 20 defines a chamber 21, which is open from the front end of the socket member 20 so as to accommodate the plug member 10 therein. The socket member 20 is provided in opposite sidewalls thereof with a pair of holes 22 so that the respective lock arms 12 are elastically coupled in the holes 22.

When the plug member 10 is inserted from the open front end of the socket member 20 through the chamber 21, the lock arms 12 formed on opposite sides of the plug member 10 are elastically bent inward as the outer side surfaces thereof slide along the inner sidewalls of the socket member 20. Then, the lock arms 12 are elastically returned outward when the ends thereof are located in the respective holes 22, thereby being seated in and fastened into the holes 22.

When attempting to unfasten the buckle, pressure may be applied from opposite outer sides to the lock arms 12 of the plug member 10, which are exposed from the holes 22 in the socket member 20, so that the respective lock arms 12 are separated from the holes 22 in the socket member 20. When the plug member 10 is pulled outward simultaneously with the separation of the lock arms 12, the plug member 10 and the socket member 20 are separated from each other.

In the conventional buckle, however, as described above, the connection of the plug member and the socket member requires a user to grip the plug member and the socket member with both hands so as to insert one into the other. In the same manner, the separation of the plug member and the socket member requires the user to grip the plug member and the socket member with both hands so as to push and separate the lock arms of the plug member.

Because the user needs to use both hands to fasten the buckle, the user cannot perform any other motion with the hands even if the user needs to manipulate, for example, a belt or strap installed on, for example, a knapsack that the user wears when performing an activity, such as climbing, trekking or the like. Also, the user needs to put down any article being held in the hands in order to fasten the buckle. Due to this troublesome manipulation, there is a demand for a buckle that enables more simplified fastening manipulation with one hand.

Although the user may try to unfasten the conventional buckle by simply pushing the lock arms of the plug member with one hand, in this case, the elastic lock arms may propel the plug member and the socket member away from each other in the course of being separated, thus causing a collision with any surrounding object.

SUMMARY OF THE INVENTION

Therefore, the present invention has been made in view of the above problems of the related art, and it is one object of the present invention to provide a buckle in which the coupling and separation of a plug member and a socket member may be implemented in a simplified manner using one hand.

It is another object of the present invention to provide a buckle in which the connection of a plug member and a socket member may be easily implemented by magnets attached to the respective members even when the members are simply brought close to each other.

It is another object of the present invention to provide a buckle in which a plug member and a socket member may remain weakly attached to each other, rather than being completely separated from each other, by magnets attached to the respective members even after the coupling between the plug member and the socket member is released.

It is a further object of the present invention to provide a buckle, to which various functional elements, such as an elevating buckle, a loop of a water supply hose, a whistle, a strap-fixing piece, and a ring, may be additionally coupled.

In accordance with an aspect of the present invention, the above and other objects can be accomplished by the provision of a buckle including a plug member and a socket member separably connected to each other, the plug member including a base, a pair of lock arms protruding from the base so as to be elastically coupled to the socket member, and a guide rod protruding from the base at a middle position between the lock arms, and the socket member including an upper plate, a lower plate, and a sidewall connecting the upper plate and the lower plate to each other so as to define a chamber, a front end of which is open so that the lock arms are accommodated in the chamber, and the socket member further including a holder provided in the chamber so that each lock arm is fastened to the holder, wherein the plug member is provided on a front end of each lock arm with an upwardly or downwardly protruding holding protrusion so that a push portion, which is pushed when attempting to separate the holding protrusion from the socket member, is located at a rear side of the holding protrusion, and wherein the socket member is provided in a middle portion thereof with an elongated guide groove for guiding the guide rod so that the chamber is divided into opposite chambers by the guide groove, each of the divided chambers being provided with upper and lower expanded holding portions for catching the holding protrusion when the plug member is completely coupled, and also being provided at an entrance side thereof with upper and lower entry slopes for guiding the holding protrusion so as to allow each lock arm to be inwardly constricted and introduced into the chamber, each entry slope being connected to the expanded holding portion.

According to a feature of the present invention, the chambers in the socket member may be formed so as to extend a shorter length than the guide groove from opposite sides of a rear end of the guide groove, and the holding protrusion and the expanded holding portion may have curved contact surfaces so as to come into close contact with each other.

According to an exemplary feature of the present invention, each lock arm may have an outer side surface, a middle portion of which protrudes outward, and the push portion may be formed so as to be inclined inward on a rear portion of the outer side surface.

According to another feature of the present invention, the guide groove may have rail grooves formed in respective opposite inner side surfaces thereof, and the guide rod may have guide ribs protruding from opposite side surfaces thereof so as to correspond to the rail grooves.

According to another feature of the present invention, the guide groove may be provided on an upper end or a lower end of each of opposite outer side surfaces thereof with a protruding guide portion for guiding the holding protrusion of the lock arm.

According to another feature of the present invention, one end of the guide rod of the plug member and one end of the guide groove in the socket member may be provided respectively with magnets so that the guide rod is strongly guided into and attached to the guide groove by the magnetic force of the magnets when the plug member and the socket member are brought close to each other.

Here, the holding protrusion of each lock arm may not be coupled to the expanded holding portion of the socket member in a state in which the magnet of the plug member and the magnet of the socket member are magnetically attached so as to coincide with each other, and the holding protrusion of the lock arm may be completely coupled to the expanded holding portion of the socket member when the plug member is further pushed in the attached state of both the magnets.

According to another feature of the present invention, each of the plug member and the socket member may include a crossbar and a strap-hooking bar, which are selectively provided at a rear side of the base.

According to another feature of the present invention, the plug member or the socket member may include an elevating rail holder provided on a rear end thereof.

According to another feature of the present invention, the plug member or the socket member may include a loop provided on a rear end thereof so as to hold and fix a hose connected to a water bottle.

According to another feature of the present invention, the plug member or the socket member may have a rear end configured to enable connection of a whistle.

According to another feature of the present invention, the plug member or the socket member may include a strap connector provided on a rear end thereof.

According to a further feature of the present invention, the plug member or the socket member may include a ring provided on a rear end thereof to enable connection of any of various loops.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, a concrete embodiment of the present invention will be described in detail with reference to the accompanying drawings.

Figure 1:
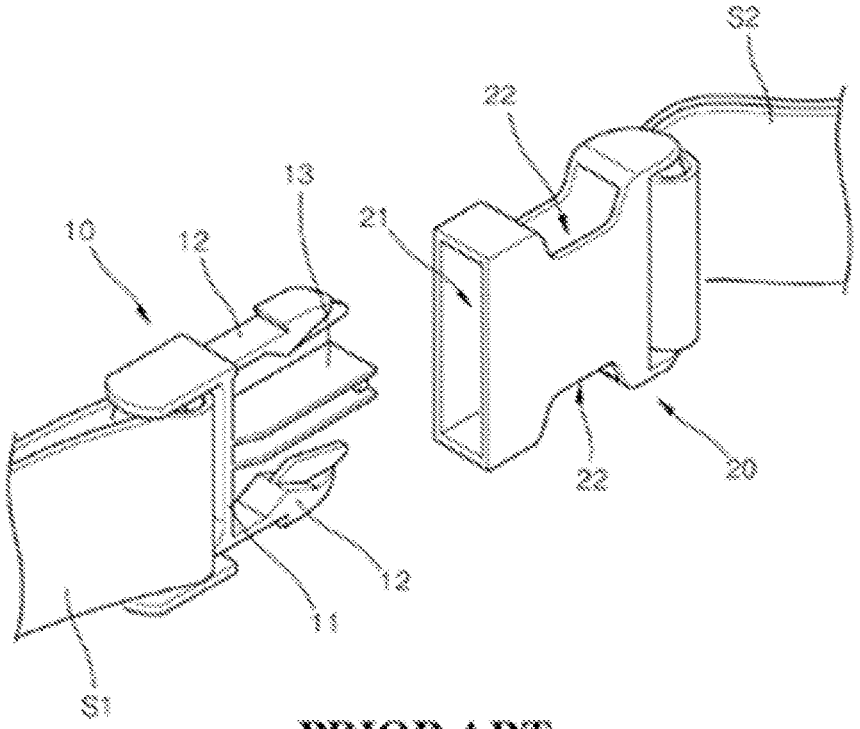
PRIOR ART FIG. 1
FIG. 1 is a perspective view illustrating an example of a conventional buckle.
Figure 2:
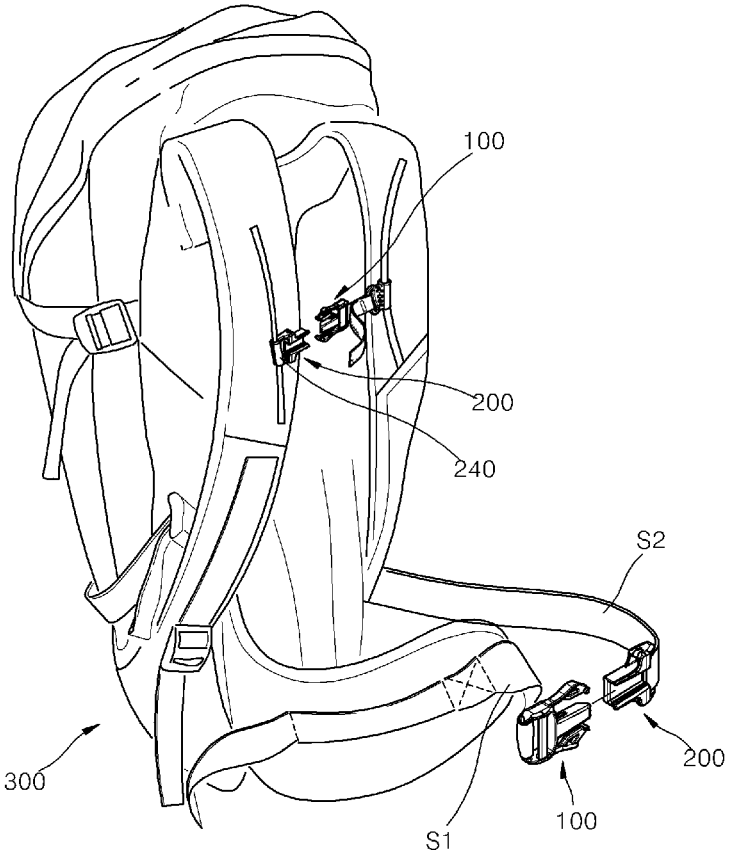
FIG. 2 is a view illustrating an embodiment in which the present invention is applied to a knapsack.
Figure 3:
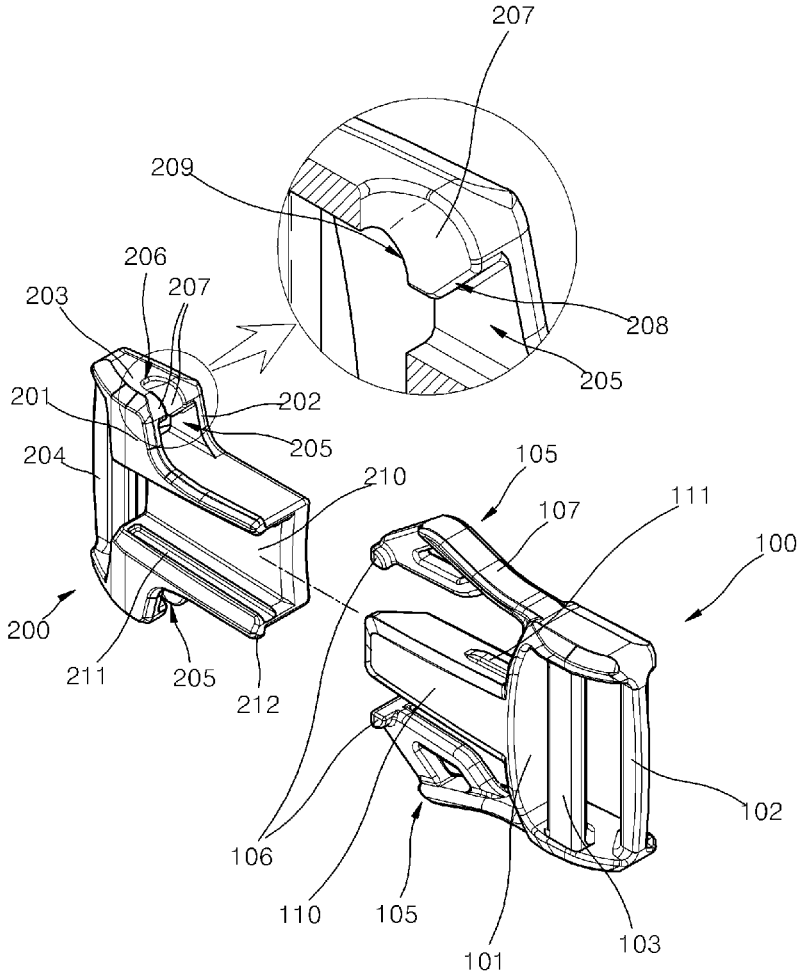
FIG. 3 is an exploded perspective view illustrating an example of a buckle according to the present invention.
Figure 4:
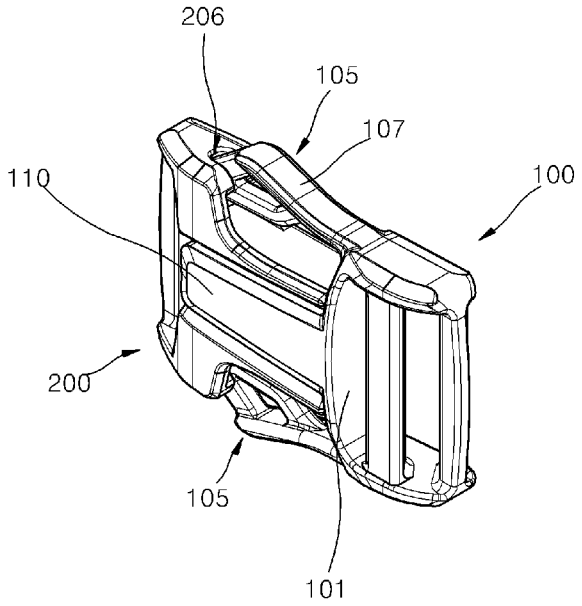
FIG. 4 is a perspective view illustrating the coupled state of FIG. 3.
Figure 5:
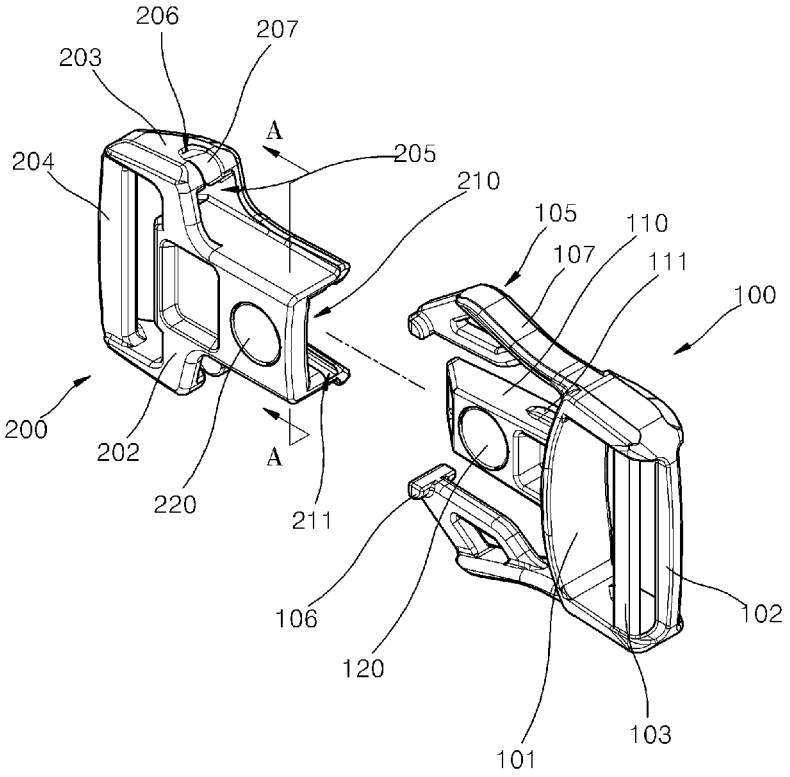
FIG. 5 is a bottom exploded perspective view of the buckle according to the present invention.
Figure 6:
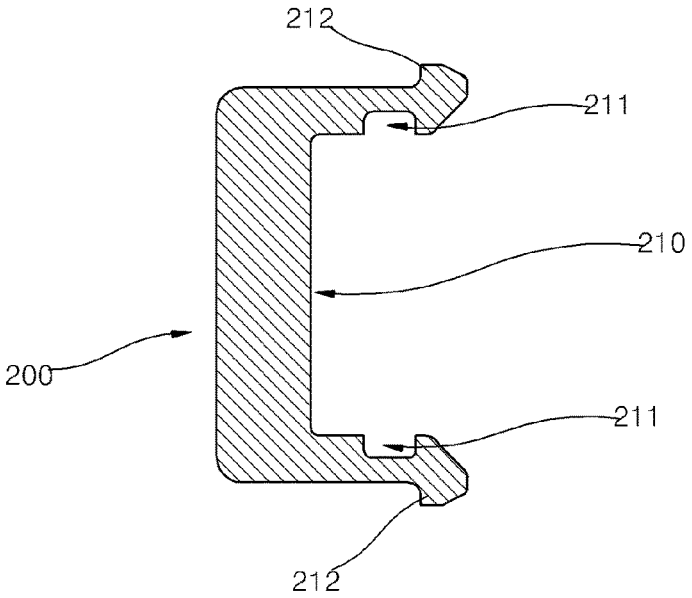
FIG. 6 is a sectional view taken along line A-A of FIG. 5.
Figure 7:
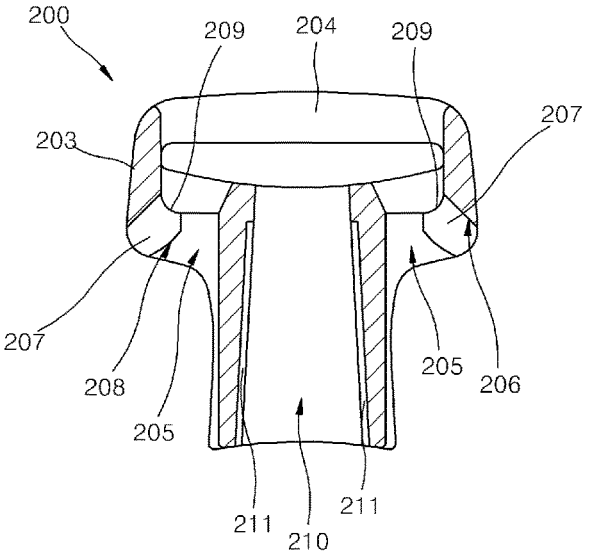
FIG. 7 is a plan sectional view of a socket member according to the present invention.

FIG. 2 is a view illustrating an embodiment in which the present invention is applied to a knapsack, FIG. 3 is an exploded perspective view illustrating an example of a buckle according to the present invention, FIG. 4 is a perspective view illustrating the coupled state of FIG. 3, FIG. 5 is a bottom exploded perspective view of the buckle according to the present invention, FIG. 6 is a sectional view taken along line A-A of FIG. 5, and FIG. 7 is a plan sectional view of a socket member according to the present invention.

Referring to FIGS. 2 to 7, the buckle according to the present invention broadly includes a plug member 100 and a socket member 200, which are separably coupled to each other. Both members are generally molded using a synthetic resin, and are used by being connected to straps S1 and S2 of, for example, a knapsack, as illustrated in FIG. 2, which is a view illustrating the buckle in use.

The plug member 100 includes a base 101, and a crossbar 102 and a strap-hooking bar 103, which are located side by side at the rear side of the base 101 and extend in the transverse direction of the plug member 100 so that a free end of the strap S1 is fitted therebetween and is wounded thereon. The strap S1 is alternately wound around the crossbar 102 and the strap-hooking bar 103 in order to enable adjustment in the length of the strap S1. Alternatively, only the crossbar 102 may be provided, in which case the free end of the strap S1 is wound around the crossbar 102 and is sewn to the crossbar 102.

A pair of lock arms 105 extends forward in the same direction from opposite sides of the base 101.

The lock arms 105 have a symmetrical form about the center of the plug member 100. Each of the lock arms 105 has a small thickness and extends from the base 101 so as to be elastically bent relative to the base 101. In this case, a middle portion or an end of the lock arm 105 may have an expanded form, or may have any other rigid structure, in order to realize a sufficient strength.

Each of the lock arms 105 is provided on the front end thereof with an upwardly or downwardly protruding holding protrusion 106. As such, a pair of upwardly and downwardly protruding holding protrusions 106 are coupled to the socket member 200.

A push portion 107 is provided on the outer surface of each lock arm 105. When it is desired to release the coupling between the holding protrusion 106 and the socket member 200, the user may apply inward pressure to push the push portion 107. Unlike the conventional buckle described above, the push portion 107 may be located at the rear side of the holding protrusion 106, and may have a greater width than a remaining portion of the lock arm 105 in order to secure sufficient contact area with a finger.

In addition, a central portion of each lock arm 105 may protrude further outward than a remaining portion of the lock arm 105, and the push portion 107 may be located at the rear side of the protruding central portion. Through this structure, sufficient push force may be applied when the user pushes the plug member 100 into the socket member 200 while gripping the push portions 107 on the opposite sides with one hand.

The plug member 100 further includes a guide rod 110 extending forward from the base 101 at a middle position between the lock arms 105, and guide ribs 111 protrude from opposite side surfaces of the guide rod 110.

The socket member 200 includes an upper plate 201 and a lower plate 202, which are opposite each other, and a sidewall 203, which connects outer ends of the upper and lower plates 201 and 202 to each other, thereby defining a chamber 205 in order to guide and accommodate the plug member 100 therein. The socket member 200 further includes a crossbar 204 provided at the rear side of the chamber 205 so as to extend in the transverse direction of the socket member 200 in order to fix a free end of the strap S2. In the same manner as the plug member 100, the socket member 200 may further include a strap-hooking bar in order to enable adjustment in the length of the strap S2.

A guide groove 210 is formed in the center of the socket member 200 so as to extend a long length in the direction in which the plug member 100 moves. The guide groove 210 is formed to divide the chamber 205 into two chambers on the opposite sides, and is open at the front and rear sides thereof and at the upper side thereof.

The guide groove 210 may have sufficient width to allow the guide rod 110 to be smoothly guided in close contact with the guide groove 210. The guide groove 210 may be wider at the entrance side thereof than at the rear portion thereof in order to guide the introduction of the guide rod 110, and correspondingly, the front end of the guide rod 110 may be gradually reduced in width with increasing distance from the base 101.

The guide groove 210 is provided in opposite inner side surfaces thereof with elongated rail grooves 211. Thereby, when the guide rod 110 is inserted, the guide ribs 111, formed on the outer side surfaces of the guide rod 110, are inserted into and guided by the rail grooves 211, which may ensure accurate movement of the plug member 100 without fluctuation.

The chambers 205 of the socket member 200, which are divided by the guide groove 210, are formed so as to extend a shorter length than the guide groove 210 from opposite sides of the rear end of the guide groove 210, such that the outer side surfaces of the guide groove 210 are exposed over a considerably long length. The exposed outer side surfaces of the guide groove 210 are provided on the upper ends thereof with protruding guide portions 212, which guide the holding protrusions 106 when the lock arms 105 are introduced into or discharged from the respective chambers 205. Alternatively, the protruding guide portions 212 may be formed on the lower ends of the outer side surfaces of the guide groove 210.

Each of the chambers 205 is provided therein with upper and lower holders 207, which are configured to catch the holding protrusion 106 of the lock arm 105 so as to realize coupling between the plug member 100 and the socket member 200. A slot 206 is formed between the upper and lower holders 207 so as to open a portion of the side surface of the chamber 205. Thereby, the front end of the lock arm 105 is fitted into the slot 206.

Each of the holders 207 includes an entry slope 208, which is gradually narrowed inward from the entrance of the chamber 205, and an outwardly expanded holding portion 209 formed at the end of the entry slope 208.

As such, the entry slope 208 and the outwardly expanded holding portion 209 are continuously connected to each other. Through this continuous structure, the holding protrusion 106 of the lock arm 105 is guided by the entry slope 208 so that the front end of the lock arm 105 is introduced into the chamber 205 while being compressed inward. Then, when the holding protrusion 106 reaches the end of the entry slope 208, the holding protrusion 106 is outwardly returned by the elasticity of the lock arm 105, thereby being caught by the outwardly expanded holding portion 209.

When both the lock arms 105 are caught by the outwardly expanded holding portions 209, the plug member 100 and the socket member 200 remain coupled to each other. The coupling between the plug member 100 and the socket member 200 is released only when the lock arms 105 are pushed from opposite sides so as to separate the holding protrusions 106 from the outwardly expanded holding portions 209.

Because the holding protrusion 106 is substantially caught by the outwardly expanded holding portion 209, contact portions of the holding protrusion 106 and the outwardly expanded holding portion 209 are processed so as to have curved surfaces, which may ensure close contact therebetween. Accordingly, the plug member 10 and the socket member 200 remain firmly fixed without movement in the coupled state thereof.

When attempting to insert the plug member 100 into the socket member 200, the guide rod 110 is first inserted into the guide groove 210 so that the guide ribs 111 are guided by the rail grooves 211, thereby guiding the introduction of the plug member 100. The respective lock arms 105 of the plug member 100 are introduced into the respective chambers 205, which are divided by the guide groove 210. After coupling is completed, the base 101 of the plug member 100 is located at the entrance of the guide groove 210. At this time, the guide rod 110 is coupled to the guide groove 210 so as to fill the entire guide groove 210. In this state, the holding protrusions 106 of the lock arms 105 are elastically coupled with the outwardly expanded holding portions 209 of the holders 207.

When the plug member 100 and the socket member 200 are coupled to each other, the guide rod 110 is inserted into the space in the guide groove 210 and the lock arms 105 are inserted into the respective chambers 205. In particular, the side surface of the front end of the lock arm 105 is thinner than the push portion 107. As the thinner portion is fitted into the slot 206 in the chamber 205, the guide groove 210 of the socket member 200 and the space defined by the chamber 205 and the slot 206 are filled with the guide rod 110 and the lock arm 105 of the plug member 100, thereby causing the plug member 100 and the socket member 200 to come into close contact with each other.

Meanwhile, the plug member 100 and the socket member 200 according to the present invention may implement coupling using magnets simultaneously with the above-described coupling. That is, a first magnet 120 and a second magnet 220 are respectively installed on one end of the guide rod 110 of the plug member 100 and one end of the guide groove 210 of the socket member 200 so as to be magnetically coupled to each other.

Each of the first magnet 120 and the second magnet 220 may be mounted in the guide rod 110 or the guide groove 210, or may be embedded in the lower surface thereof. Here, the first magnet 120 may be embedded in the front end or at a middle position of the guide rod 110, and the second magnet 220 may be installed close to the front end of the guide groove 210.

Accordingly, in the state in which the first magnet 120 and the second magnet 220 are magnetically attached to each other, a portion of the guide rod 110 is introduced into the guide groove 210, and the holding protrusion 106, formed on the front end of each lock arm 105, is located close to the entrance of the chamber 205, rather than being introduced into the chamber 205. That is, the plug member 100 and the socket member 200 are attached to each other, but are in a provisionally connected state, rather than being completely coupled to each other.

In addition, the state described above is the state immediately before the guide rib 111, formed on the side surface of the guide rod 110, is fitted into the rail groove 211. To this end, the guide rib 111 may be formed on the rear end of the side surface of the guide rod 110. In the state in which the first magnet 120 and the second magnet 220 are attached to each other, the front end of the guide rib 111 is located close to the entrance of the guide groove 210.

When the plug member 100 is pushed into the socket member 200 in this state, the holding protrusion 106 is introduced into the chamber 205 and is caught by the outwardly expanded holding portion 209, thereby causing the plug member 100 and the socket member 200 to be completely coupled to each other.

The action of the buckle according to the present invention having the configuration described above will be described below.

Figure 8A:
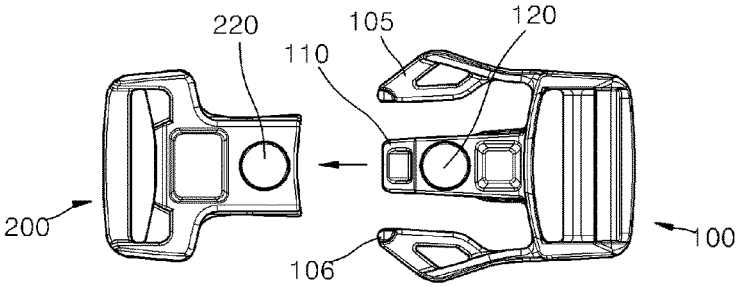
FIGS. 8A-8D are views illustrating the coupling sequence of a plug member and the socket member according to the present invention.
Figure 8B:
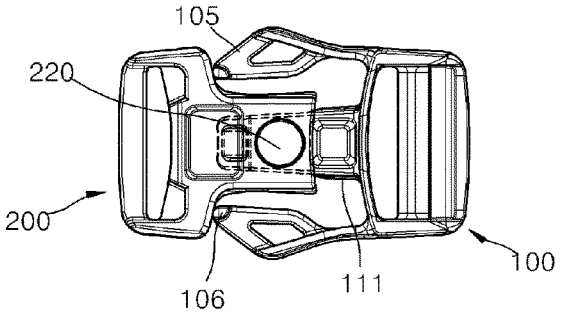
Figure 8C:
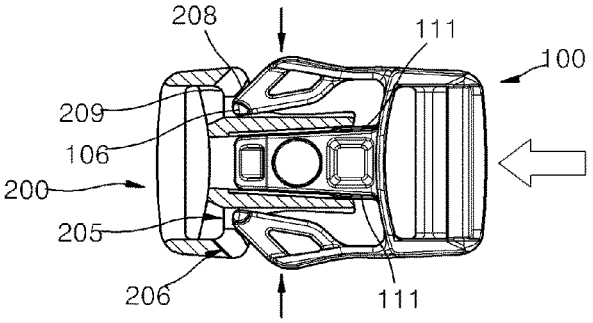
Figure 8D:
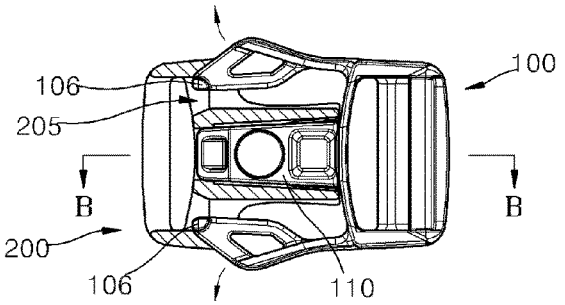
Figure 9:
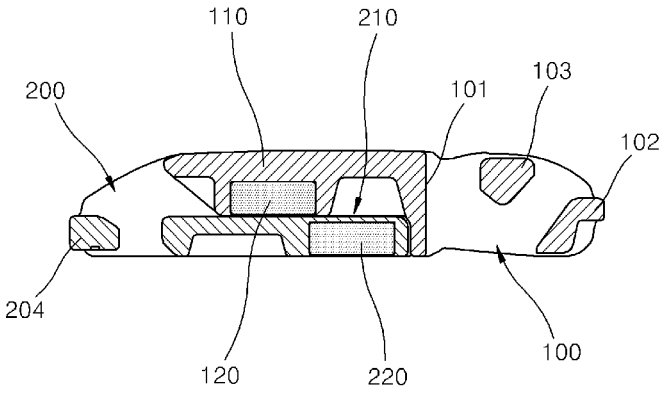
FIG. 9 is a sectional view taken along line B-B of FIG. 8D.

FIGS. 8A-8D are views illustrating the coupling sequence of the buckle according to the present invention, and FIG. 9 is a sectional view taken along line B-B of FIG. 8D, illustrating the positions of the magnets in the state in which the plug member and the socket member are completely coupled to each other.

First, when one member, among the plug member 100 and the socket member 200, is brought close to the other member in order to couple the plug member 100 and the socket member 200 to each other, the plug member 100 and the socket member 200 attract each other by the magnetic force of the first magnet 120 and the second magnet 220, thereby causing the first magnet 120 and the second magnet 220 to be momentarily attached to each other. Thereby, as illustrated in FIG. 8(B), the guide rod 110 of the plug member 100 is naturally seated in the guide groove 210 in the socket member 200.

In the state in which the first magnet 120 and the second magnet 220 are attached to each other, the lock arms 105 of the plug member 100 are not yet introduced into the chambers 205 in the socket member 200, and the plug member 100 and the socket member 200 are in the provisionally connected state, in which the holding protrusions 106 formed on the front end of the lock arms 105 are close to the entrance of the chambers 205.

In this state, as illustrated in FIG. 8(C), when the plug member 100 is pushed into the socket member 200, the guide rod 110 is introduced into the guide groove 210 so that the guide ribs 111 are introduced into the rail grooves 211, and simultaneously, each lock arm 105 is introduced into the chamber 205 so that the holding protrusion 106 is guided by the entry slope 208 of the holder 207. Thereby, the front end of the lock arm 105 is introduced while being pushed inward and compressed.

When the lock arm 105 is continuously introduced until the holding protrusion 106 reaches the region at which the entry slope 208 ends, the front end of the lock arm 105 is elastically moved outward and returned by the elasticity of the lock arm 105, thereby causing the holding protrusion 106 to be seated on and fixed by the outwardly expanded holding portion 209 as illustrated in FIG. 8(D).

FIG. 9 is a sectional view illustrating the same state shown in FIG. 8(D). When the plug member 100 and the socket member 200 are completely coupled to each other, the first magnet 120 and the second magnet 220 slightly deviate from each other, and the coupling between the holding protrusion 106 and the outwardly expanded holding portion 209 controls the attractive force between the magnets 120 and 220.

In the course of introducing the plug member 100 into the socket member 200, the guide rib 111, formed on the side surface of the guide rod 110, is connected to and guided by the rail groove 211 of the guide groove 210, which may allow the plug member 100 to be stably moved in a straight line.

The operation described above is realized with one hand. When one member, among the plug member 100 and the socket member 200, is brought close to the other member, the first magnet 120 and the second magnet 220 strongly attract each other, causing the guide rod 110 to be naturally guided into the guide groove 210.

The chambers 205 of the socket member 200 are formed so as to extend a shorter length than the guide groove 210 from opposite sides of the rear end of the guide groove 210, and thus most of the outside of the guide groove 210 is empty space. Therefore, when the guide rod 110 is guided along the guide groove 210 by magnetic force, the lock arms 105 at opposite sides of the guide groove 210 do not completely prevent the movement of the guide rod 110.

In addition, because the guide rib 111 is formed on the rear portion of the side surface of the guide rod 110, the guide rib 111 does not completely prevent the magnetic force from bringing the guide rod 110 into close contact with the guide groove 210.

The holding protrusion 106 of the lock arm 105 seated as described above comes into close contact with the outwardly expanded holding portion 209 of the plug member 100, thereby remaining fixed without moving.

Then, when the plug member 100 and the socket member 200 are coupled to each other, the guide rod 110 and the guide groove 210 come into close contact with each other and the front end of the lock arm 105 comes into close contact with and is connected to the chamber 205 and the slot 206. In this way, the plug member 100 and the socket member 200 are integrally and closely coupled to each other.

When attempting to separate the plug member 100 from the socket member 200, inward pressure is applied to the push portion 107 from the outside of the lock arm 105 so that the holding protrusion 106 of the lock arm 105 is separated from the outwardly expanded holding portion 209 of the socket member 200, and simultaneously, the plug member 100 and the socket member 200 are momentarily moved away from each other by the magnetic force of the first magnet 120 and the second magnet 220. Thereby, the first magnet 120 and the second magnet 220 are attached to each other, causing the plug member 100 and the socket member 200 to enter the provisionally connected state.

In this state, the connection between the plug member 100 and the socket member 200 may be simply released by simply separating the magnets 120 and 220 from each other.

Because the plug member 100 and the socket member 200 may be provisionally connected to each other by the magnets 120 and 220, even while the coupling between the plug member 100 and the socket member 200 is being implemented with one hand, an operation of coupling and separating, for example, a belt or a strap may be performed with the other hand in some cases. The ability to perform different operations at the same time with respective hands is very advantageous.

For example, in a situation, such as, for example, performing any of various tasks or climbing, one hand may often be used to grip or hold something. In this situation, it may be difficult to couple or release a buckle using two hands.

According to the present invention, the buckle may be coupled or released with only one hand in the situation mentioned above, which may provide excellent convenience.

Figure 10:
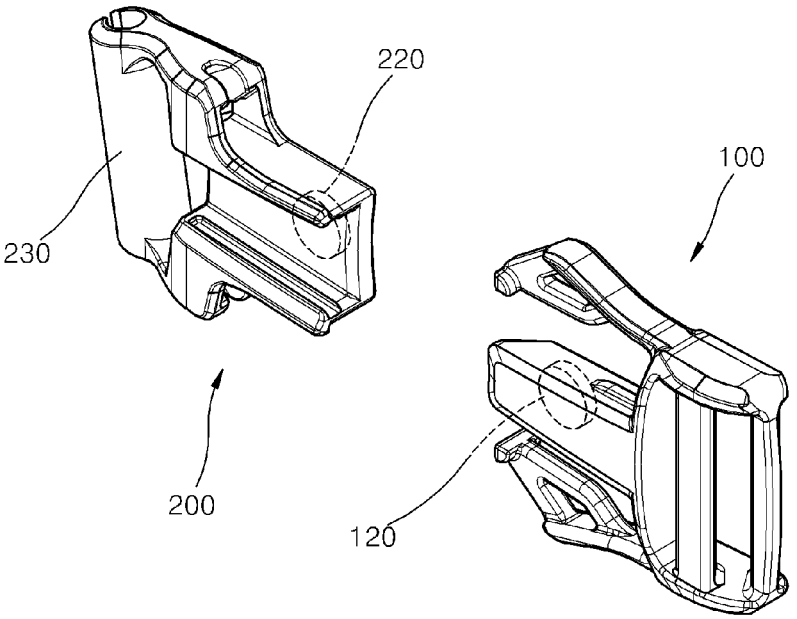
FIGS. 10 to 13 are exploded perspective views illustrating other embodiments of the present invention.

FIGS. 10 to 13 illustrate other embodiments of the present invention. FIG. 10 illustrates an embodiment in which, instead of the crossbar, an elevating rail holder 230 is provided on the rear end of the socket member 200, which is coupled to the plug member 100. As such, the buckle may be applied as an elevating buckle, which is installed to, for example, a shoulder strap of a knapsack. The elevating rail holder 230 may be installed on the rear end of the plug member 100.

Because the elevating buckle is installed to, for example, the shoulder strap of the knapsack so as to be vertically moved, even in this case, the plug member 100 and the socket member 200 may be respectively provided with the first magnet 120 and the second magnet 220, thereby being simply connected to each other by magnetic force when they are simply brought close to each other.

Figure 11:
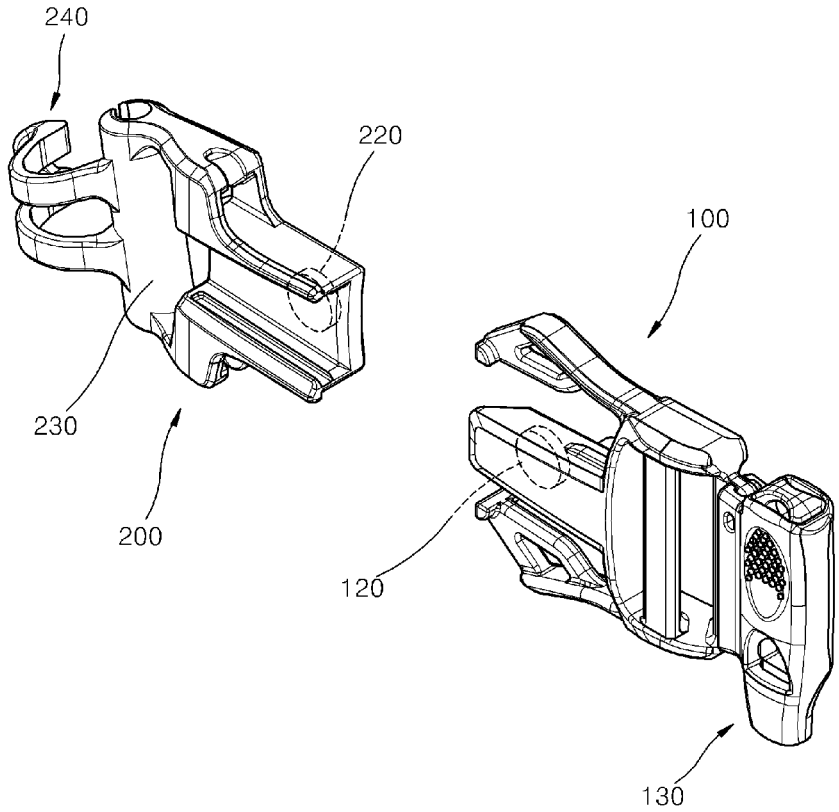

FIG. 11 illustrates an embodiment in which, in addition to FIG. 10, a loop 240 may be formed on one end of the elevating rail holder 230, which is formed on the rear end of the socket member 200. As such, a water supply hose, which is connected to a water bottle, may be connected and fixed to the elevating buckle, which is located on the chest region of the knapsack. In addition, a whistle 130 may be fitted to the crossbar on the rear end of the plug member 100 so as to be carried along with the buckle.

When the user who wears a knapsack goes climbing or trekking, the user may carry a water bottle in the knapsack and may try to drink water through a hose of the water bottle without taking off the knapsack. In this case, the hose may be held and fixed on the loop 240, which ensures the convenient use of the hose.

In addition, when the whistle 130 is carried by being connected to the rear end of the plug member 100 according to the present invention, the whistle 130 may be simply used in an emergency situation.

When the loop 240 or the whistle 130 is applied to the plug member 100 and the socket member 200, which may be easily coupled to or separated from each other by the magnets 120 and 220, various additional functions may be applied to the buckle.

Figure 12:
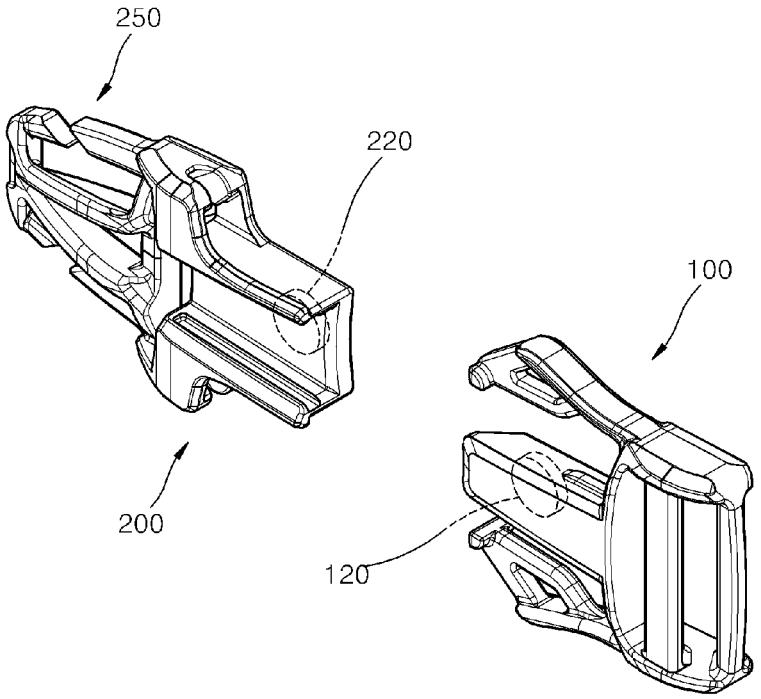

FIG. 12 illustrates an embodiment in which a strap connector 250 is provided on the rear end of the socket member 200, which is coupled to the plug member 100, so that the socket member 200 may be installed so as to be movable along a strap.

A strap installed on, for example, a knapsack or a bag may be fitted into the strap connector 250 so that the buckle is movable on the strap so as to be adjustable in position. In the state in which the buckle is mounted on the strap, the plug member 100 and the socket member 200 may be conveniently coupled or separated to or from each other using the magnets 120 and 220.

Figure 13:
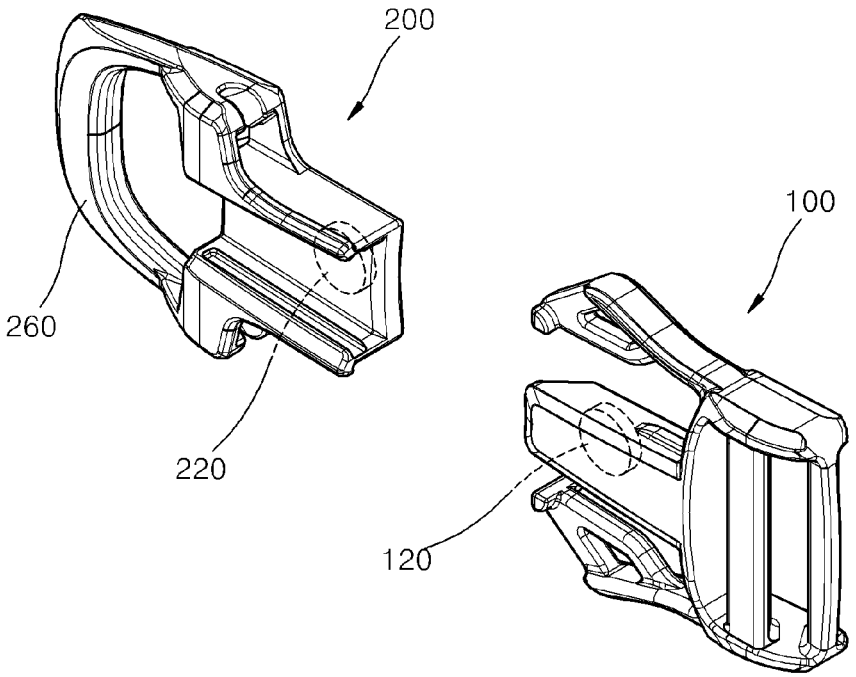

FIG. 13 illustrates an embodiment in which, instead of the crossbar, a ring 260 may be provided on the rear end of the socket member 200, which is coupled to the plug member 100. Any of various small articles may be carried by being held on the ring 260, or a loop, which is installed on, for example, a suspender or a strap, may be connected to the ring 260.

That is, when the ring 260 is provided on the socket member 200 and the plug member 100, which are provided with the magnets 120 and 220, any of various loops or small articles may be held on the ring 260. Thereby, the ring 260 may provide the buckle with various functionalities.

As is apparent from the above description, in a buckle of the present invention, magnets are provided in a guide rod of a plug member and a guide groove of a socket member so as to correspond to each other. Thereby, the plug member and the socket member may be primarily coupled to each other via magnetic attraction when they are simply brought close to each other. When the plug member is merely pushed with one hand in this state, the coupling between the plug member and the socket member may be accomplished, which enables more convenient use of the buckle.

In addition, even in the state in which a lock arm is released from the socket member in order to unfasten the buckle, the plug member and the socket member remain weakly attached to each other by the magnets, which prevents, for example, a strap assembled with the buckle, from drooping or shaking.

In addition, various functional elements, such as an elevating buckle, a loop for a water supply hose, a whistle, a strap-fixing piece, and a ring, may be additionally coupled to the buckle according to the present invention, which enables utilization of the buckle across various fields.

What is claimed is:

1. A buckle comprising a plug member and a socket member separably connected to each other, the plug member including a base, a pair of lock arms protruding from the base so as to be elastically coupled to the socket member, and a guide rod protruding from the base at a middle position between the lock arms, and the socket member including an upper plate, a lower plate, and a sidewall connecting the upper plate and the lower plate to each other so as to define a chamber, a front end of which is open so that the lock arms are accommodated in the chamber, and the socket member further including a holder provided in the chamber so that each lock arm is fastened to the holder, wherein the plug member is provided on a front end of each lock arm with an upwardly or downwardly protruding holding protrusion so that a push portion, which is pushed when attempting to separate the holding protrusion from the socket member, is located at a rear side of the holding protrusion, wherein the socket member is provided in a middle portion thereof with an elongated guide groove for guiding the guide rod so that the chamber is divided into opposite chambers by the guide groove, each of the divided chambers being provided with upper and lower expanded holding portions for catching the holding protrusion when the plug member is completely coupled, and also being provided at an entrance side thereof with upper and lower entry slopes for guiding the holding protrusion so as to allow each lock arm to be inwardly constricted and introduced into the chamber, each entry slope being connected to the expanded holding portion, and wherein the guide groove has rail grooves disposed in respective opposite inner side surfaces thereof, and the guide rod has guide ribs protruding from opposite side surfaces thereof so as to correspond to the rail grooves.

2. The buckle according to claim 1, wherein the chambers in the socket member are formed so as to extend a shorter length than the guide groove from opposite sides of a rear end of the guide groove.

3. The buckle according to claim 1, wherein the holding protrusion and the expanded holding portion have curved contact surfaces so as to come into close contact with each other.

4. The buckle according to claim 1, wherein each lock arm has an outer side surface, a middle portion of which protrudes outward, and the push portion is formed so as to be inclined inward on a rear portion of the outer side surface.

5. The buckle according to claim 1, wherein the guide groove is provided on an upper end or a lower end of each of opposite outer side surfaces thereof with a protruding guide portion for guiding the holding protrusion of the lock arm.

6. The buckle according to claim 1, wherein the plug member or the socket member includes an elevating rail holder provided on a rear end thereof.

7. The buckle according to claim 1, wherein the plug member or the socket member includes a loop provided on a rear end thereof so as to hold and fix a hose connected to a water bottle.

8. The buckle according to claim 1, wherein the plug member or the socket member has a rear end configured to enable connection of a whistle.

9. A buckle comprising a plug member and a socket member separably connected to each other in a coupling direction, the plug member including a base, a pair of lock arms protruding from the base so as to be elastically coupled to the socket member, and a guide rod protruding from the base at a middle position between the lock arms, and the socket member including an upper plate, a lower plate, and a sidewall connecting the upper plate and the lower plate to each other so as to define a chamber, a front end of which is open so that the lock arms are accommodated in the chamber, and the socket member further including a holder provided in the chamber so that each lock arm is fastened to the holder, wherein the plug member is provided on a front end of each lock arm with a holding protrusion so that a push portion, which is pushed when attempting to separate the holding protrusion from the socket member, is located at a rear side of the holding protrusion, and the guide rod is provided with a first magnet in one end thereof, wherein the socket member is provided in a middle portion thereof with an elongated guide groove for guiding the guide rod so that the chamber is divided into opposite chambers by the guide groove, each chamber being provided with an expanded holding portion for catching the holding protrusion when the plug member is completely coupled, and also being provided at an entrance side thereof with an entry slope for guiding the holding protrusion so as to allow each lock arm to be inwardly constricted and introduced into the chamber, the entry slope being connected to the expanded holding portion, and the guide groove is provided with a second magnet, which corresponds to the first magnet of the guide rod, so that the guide rod is strongly guided into and attached to the guide groove by magnetic force of the magnets when the plug member and the socket member are brought close to each other, and wherein the first magnet of the plug member and the second magnet of the socket member are configured to coincide transversely to the coupling direction.

10. The buckle according to claim 9, wherein the holding protrusion of each lock arm is not coupled to the expanded holding portion of the socket member in an attached state in which the first magnet of the plug member and the second magnet of the socket member are magnetically attached so as to coincide with each other, and wherein the holding protrusion of the lock arm is completely coupled to the expanded holding portion of the socket member when the plug member is further pushed in the coupling direction from the attached state such that the magnets do not coincide with each other.

11. The buckle according to claim 9, wherein the chambers in the socket member are formed so as to extend a shorter length than the guide groove from opposite sides of a rear end of the guide groove.

12. The buckle according to claim 9, wherein the holding protrusion and the expanded holding portion have curved contact surfaces so as to come into close contact with each other.

13. The buckle according to claim 9, wherein each lock arm has an outer side surface, a middle portion of which protrudes outward, and the push portion is formed so as to be inclined inward on a rear portion of the outer side surface.

14. The buckle according to claim 9, wherein the guide groove has rail grooves formed in respective opposite inner side surfaces thereof, and the guide rod has guide ribs protruding from opposite side surfaces thereof so as to correspond to the rail grooves.

15. The buckle according to claim 9, wherein the guide groove is provided on an upper end or a lower end of each of opposite outer side surfaces thereof with a protruding guide portion for guiding the holding protrusion of the lock arm.

16. The buckle according to claim 9, wherein the plug member or the socket member includes an elevating rail holder provided on a rear end thereof.

17. The buckle according to claim 9, wherein the plug member or the socket member includes a loop provided on a rear end thereof so as to hold and fix a hose connected to a water bottle.

18. The buckle according to claim 9, wherein the plug member or the socket member has a rear end configured to enable connection of a whistle.

19. The buckle according to claim 9, wherein the plug member or the socket member includes a strap connector provided on a rear end thereof.

* * * * *